US008468962B2

(12) United States Patent
Tseng et al.

(10) Patent No.: US 8,468,962 B2
(45) Date of Patent: Jun. 25, 2013

(54) SEWING MACHINE WITH A THREAD HOLDING DEVICE FOR HOLDING NEEDLE THREAD REMAINING

(75) Inventors: Shui-Chun Tseng, Taichung (TW); Hsueh-Hua Liu, Taichung (TW); Rick Cho, Taichung (TW)

(73) Assignee: Zeng Hsing Industrial Co., Ltd. (TW)

( * ) Notice: Subject to any disclaimer, the term of this patent is extended or adjusted under 35 U.S.C. 154(b) by 116 days.

(21) Appl. No.: 13/235,313

(22) Filed: Sep. 16, 2011

(65) Prior Publication Data

US 2013/0068145 A1 Mar. 21, 2013

(51) Int. Cl.
*D05B 47/04* (2006.01)

(52) U.S. Cl.
USPC ..... 112/302; 112/255

(58) Field of Classification Search
USPC ..... 112/253, 302, 254, 255
See application file for complete search history.

(56) References Cited

U.S. PATENT DOCUMENTS

| | | | | | |
|---|---|---|---|---|---|
| 2,937,605 | A | * | 5/1960 | Walling et al. | 112/254 |
| 5,022,335 | A | * | 6/1991 | Hanyu et al. | 112/255 |
| 5,042,407 | A | * | 8/1991 | Jimenez | 112/254 |
| 5,363,786 | A | * | 11/1994 | Hampel et al. | 112/255 |
| 5,680,827 | A | * | 10/1997 | Sakanobe et al. | 112/443 |
| 5,711,238 | A | * | 1/1998 | Matsuo et al. | 112/255 |

* cited by examiner

*Primary Examiner* — Danny Worrell
(74) *Attorney, Agent, or Firm* — The Mueller Law Office, P.C.

(57) ABSTRACT

A sewing machine includes a thread holding device disposed downstream of a thread take-up lever and upstream of a needle bar in terms of a threading path of a needle thread, and including a fixed first disc and a movable second disc movable by an electromechanical unit between holding and releasing positions to be closer to and remote from the first disc, respectively. The first and second discs respectively have first and second holding surfaces cooperatively defining a thread holding clearance to permit passage of the needle thread therethrough. The needle thread can be clamped in the thread holding clearance so as to prevent the needle thread being pulled out of the needle during a thread cutting procedure. A required amount of the needle thread remaining on the needle can be secured.

8 Claims, 7 Drawing Sheets

SEWING MACHINE WITH A THREAD HOLDING DEVICE FOR HOLDING NEEDLE THREAD REMAINING

BACKGROUND OF THE INVENTION

1. Field of the Invention

This invention relates to a sewing machine, more particularly to a sewing machine with a thread holding device for holding a required amount of needle thread remaining on a sewing needle.

2. Description of the Related Art

A conventional electronic sewing machine generally includes a plurality of thread guides, such as a needle thread regulating member, a guide frame, a take-up spring, a thread take-up lever, a needle-bar thread guide, and the like, where a needle thread extending from a spool is passed through a predetermined threading path. The needle thread is then passed through an eye of a needle. Subsequent to a thread cutting procedure, the thread take-up lever is swung upward to its top dead center to move the needle bar away from a needle plate. At that point, the needle thread may be pulled out of the needle eye by the upward moving the thread take-up lever, so that manually rethreading the needle is necessary, which is very troublesome.

SUMMARY OF THE INVENTION

An object of the present invention is to provide a sewing machine which has a thread holding device for holding a required amount of needle thread remaining on a sewing needle.

According to this invention, the sewing machine includes a sewing head, a needle bar mounted on the sewing head to be reciprocally movable upward and downward, and having a needle-bar thread guide, a thread take-up lever mounted on the sewing head and upwardly of the needle bar to be swung upward and downward in synchronization with the needle bar, and having a lever threading portion which is disposed upstream of the needle-bar thread guide in terms of a threading path of a needle thread, a thread guide frame mounted on the sewing head and between the needle bar and the thread take-up lever, and a thread holding device including a first disc, a second disc, an electromechanical unit, and a biasing member. The first disc is fixed to the thread guide frame, and has a first holding surface which faces the threading path and upstream of the needle-bar thread guide. The second disc is movable relative to the first disc between holding and releasing positions, where the second disc is closer to and remote from the first disc, respectively, and has a second holding surface which confronts and cooperates with the first holding surface to define a thread holding clearance so as to permit passage of the needle thread therethrough such that, in the releasing position, the needle thread is permitted to continue on running from the lever threading portion to the needle-bar thread guide, and such that, in the holding position, the needle thread is arrested from moving along the threading path. The electromechanical unit is disposed to be actuated to thrust the second disc to the holding position. The biasing member is disposed to bias the second disc toward the releasing position.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
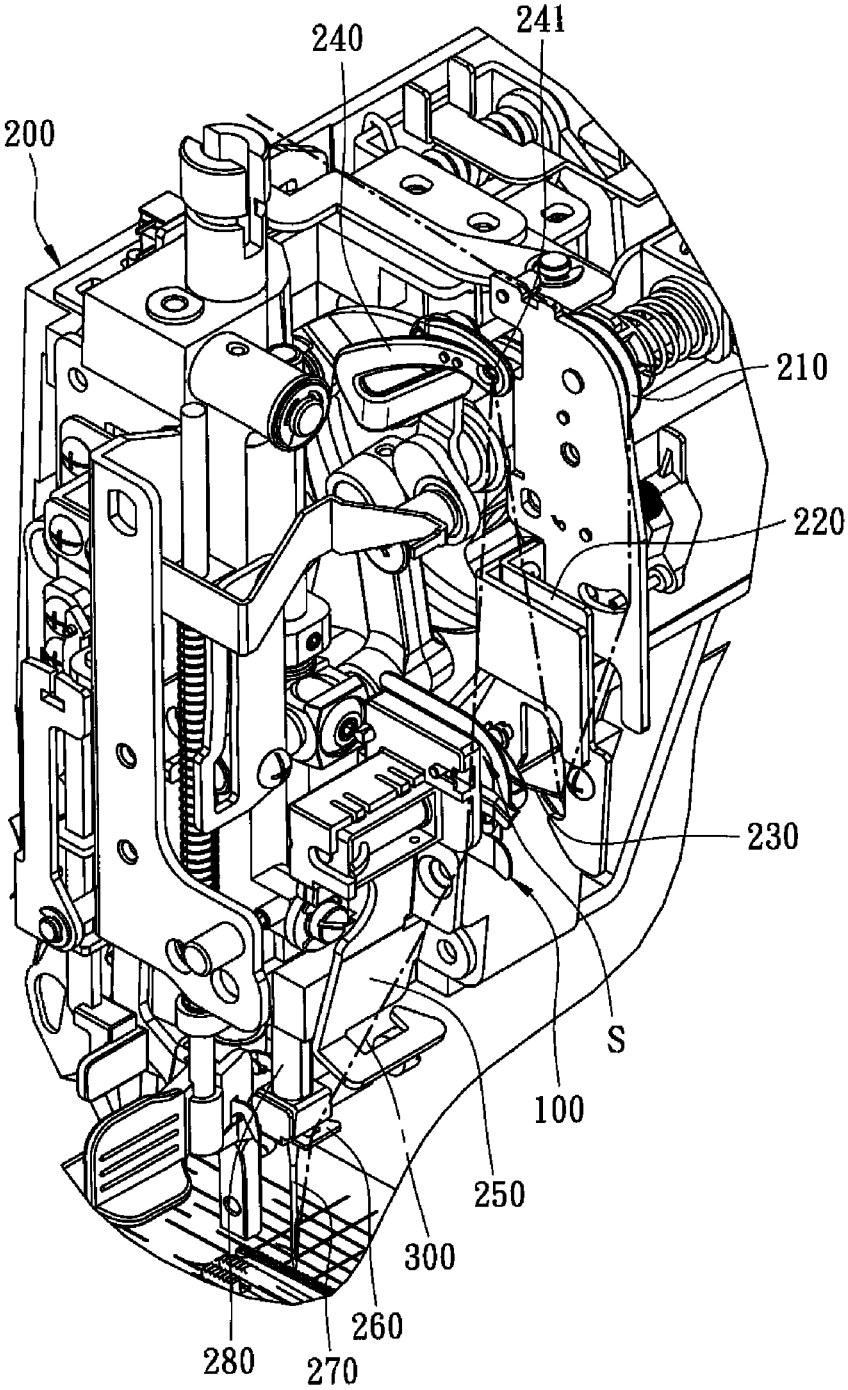
FIG. 1 is a fragmentary perspective view of the embodiment of a sewing machine according to this invention.

Referring to FIG. 1, the embodiment of a sewing machine according to the present invention is shown to comprise a sewing head 200 which is provided with a needle thread regulating member 210, a guide plate 220, and a take-up spring 230, a needle bar 280 which is mounted on the sewing head 200 to be reciprocally movable upward and downward, and which has a lower portion to which a needle 270 and a needle-bar thread guide 260 are attached, a thread take-up lever 240 which is mounted on the sewing head 200 and upwardly and forwardly of the needle bar 280 to be swung upward and downward in synchronization with the needle bar 280, and which has a lever threading portion 241 that is disposed upstream of the needle-bar thread guide 260 in terms of a threading path of a needle thread 300, and a thread guide frame 250 mounted on the sewing head 200 and between the needle bar 280 and the thread take-up lever 240. The needle thread 300 extending from a spool (not shown) is passed sequentially through the needle thread regulating member 210, the guide plate 220, the take-up spring 230, the lever threading portion 241 of the thread take-up lever 240, the needle-bar thread guide 260, and an eye of the needle 270. The sewing machine of this embodiment further comprises a thread holding device 100 disposed between the lever threading portion 241 and the needle-bar thread guide 260 in terms of the threading path of the needle thread 300.

Figure 2:
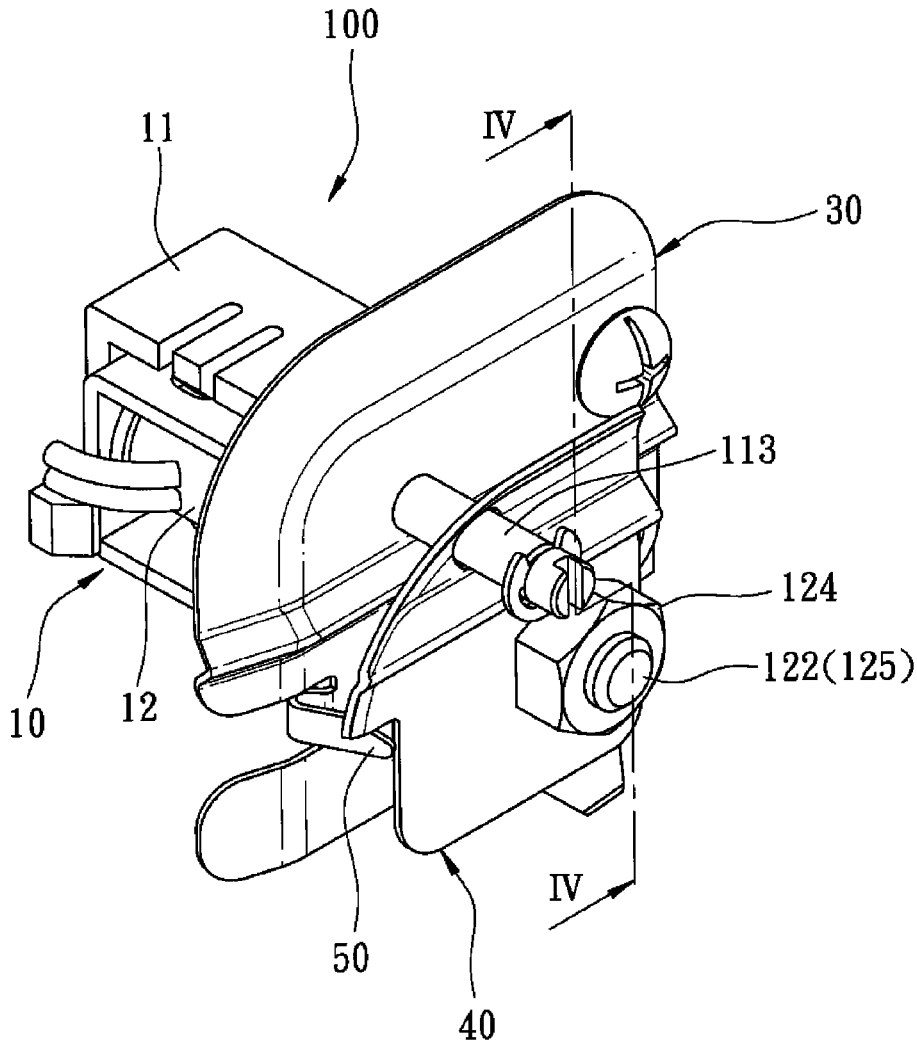
FIG. 2 is a perspective view of a thread holding device of the embodiment.
Figure 3:
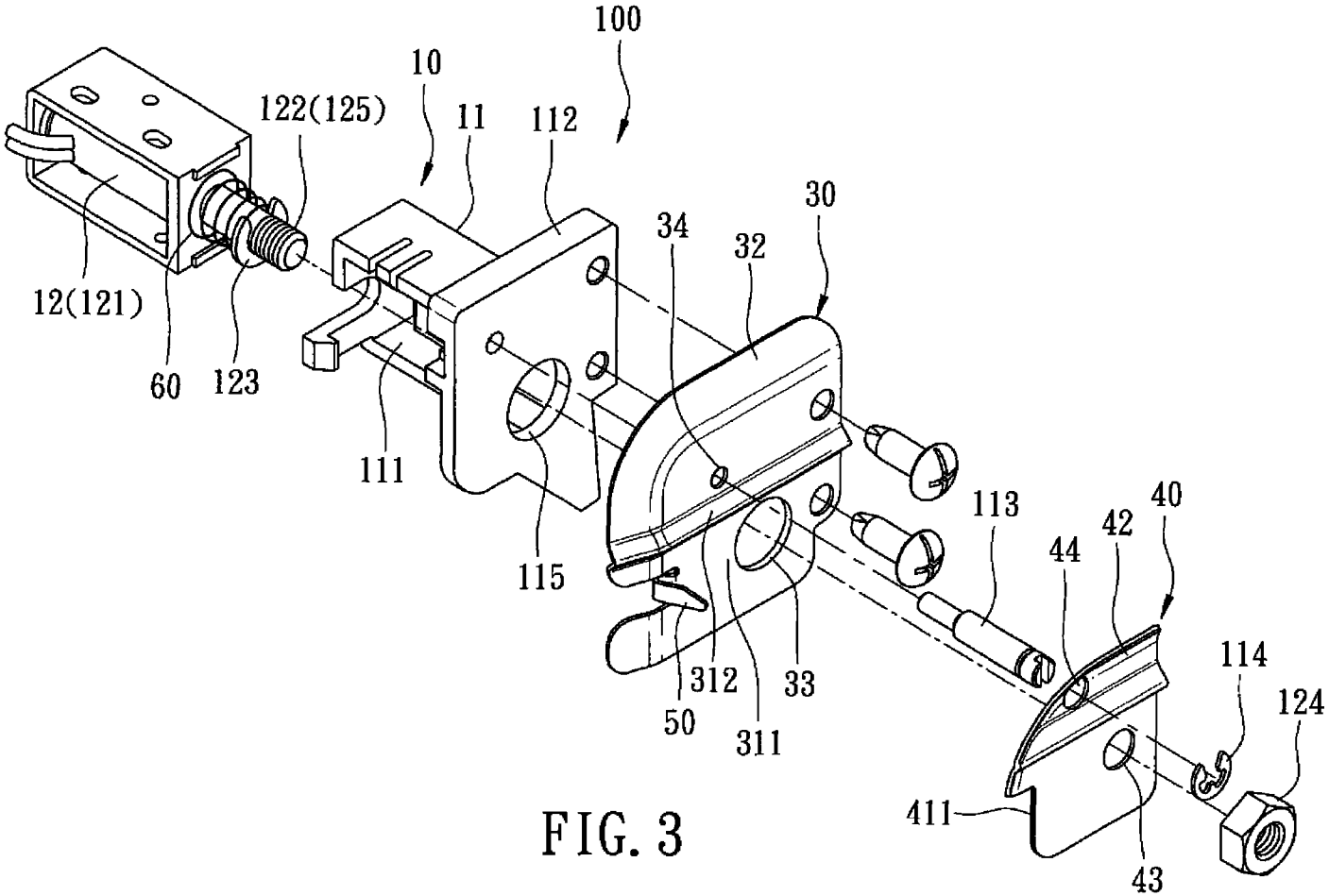
FIG. 3 is an exploded perspective view of the thread holding device.

Referring to FIGS. 2 and 3, the thread holding device 100 includes a first disc 30, a second disc 40, an electromechanical unit 10, and a biasing member 60.

Figure 4:
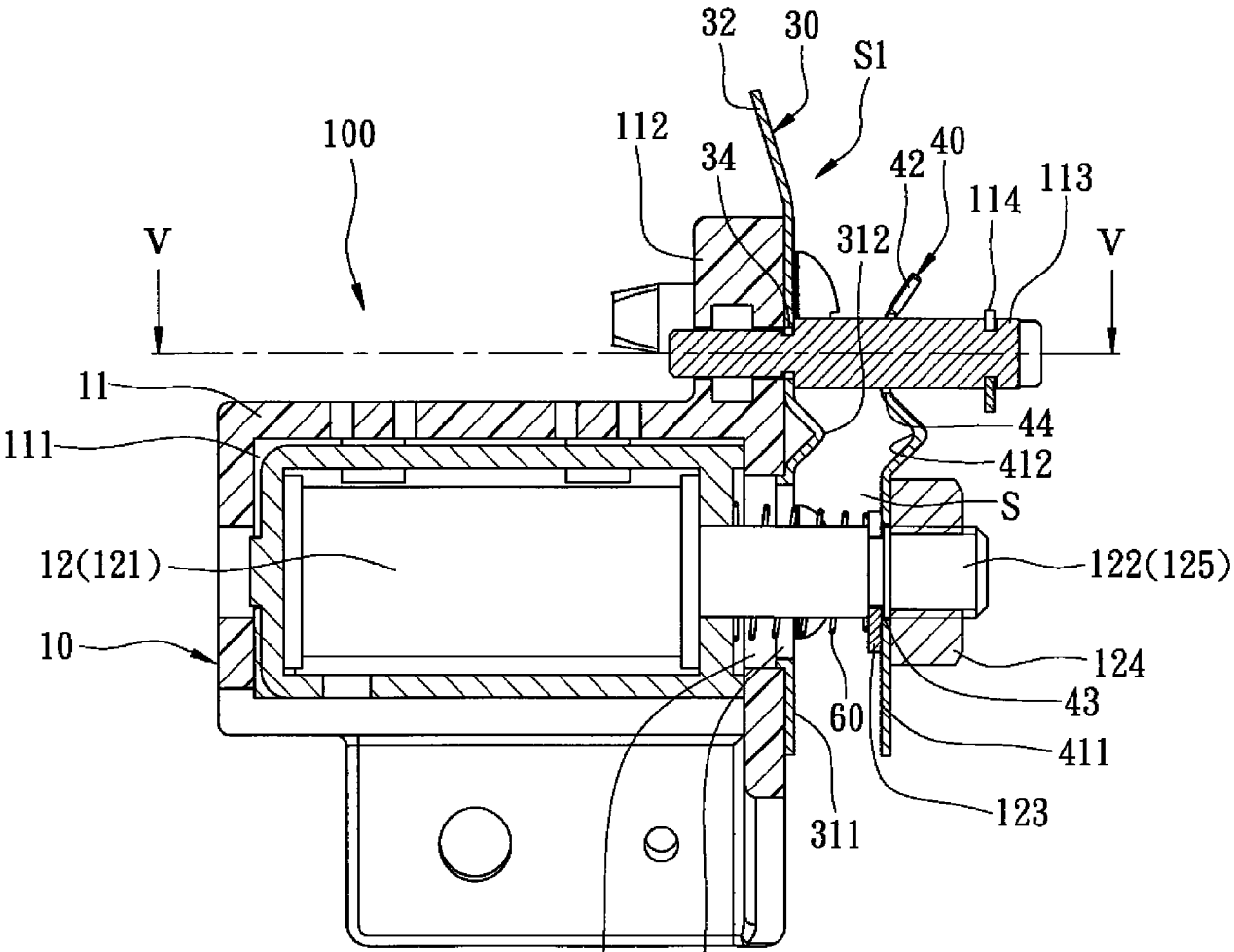
FIG. 4 is a sectional view taken along line IV-IV of FIG. 2.
Figure 5:
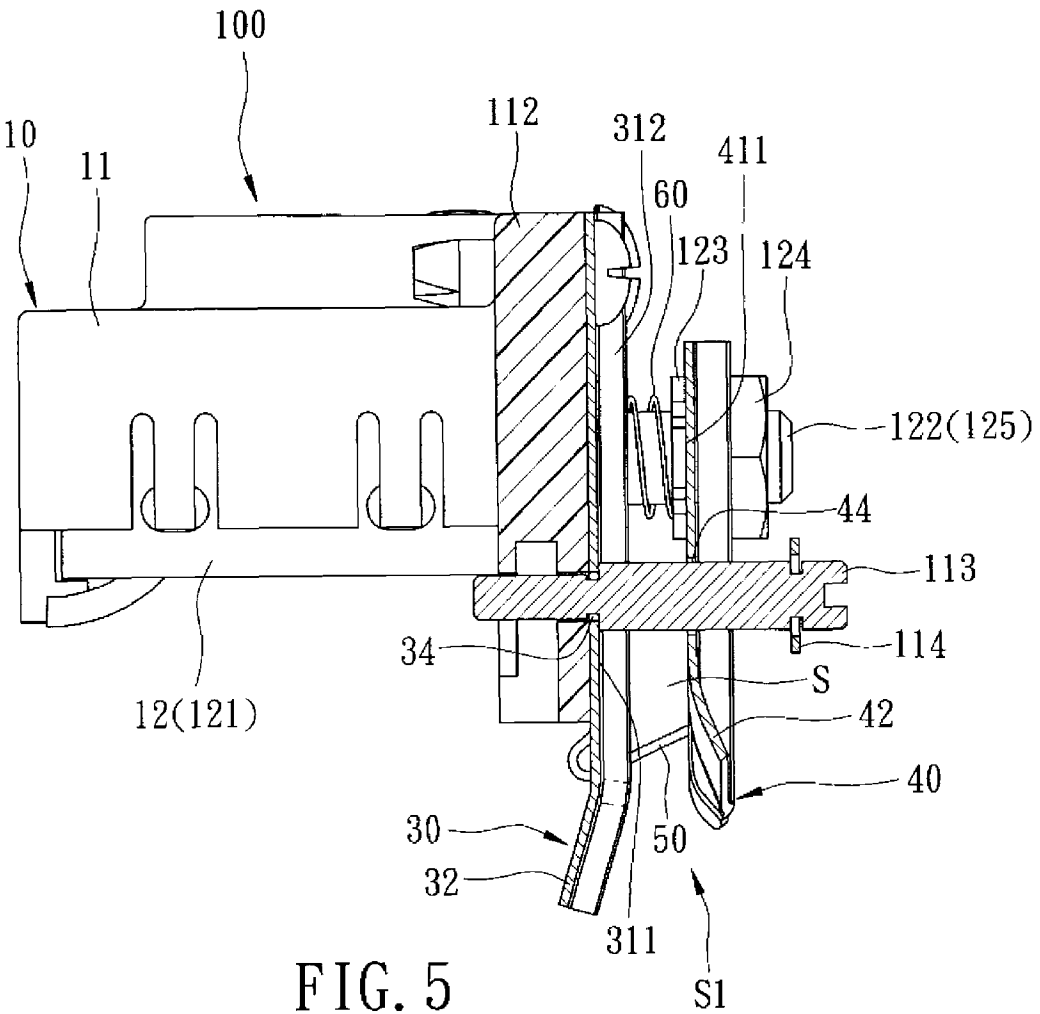
FIG. 5 is a sectional view taken along line V-V of FIG. 4.

Referring to FIGS. 3 to 5, the first disc 30 is fixed to the thread guide frame 250 (see FIG. 1), and has a first holding surface 311 which faces the threading path, a rib region 312 which is disposed on the first holding surface 311 and which extends transversely relative to the threading path of the needle thread 300, a plunger hole 33 and a shaft hole 34 which extend axially therethrough. The first disc 30 further has a fencing portion 50 which extends axially from the first holding surface 311 and which is disposed at the threading path.

Figure 6:
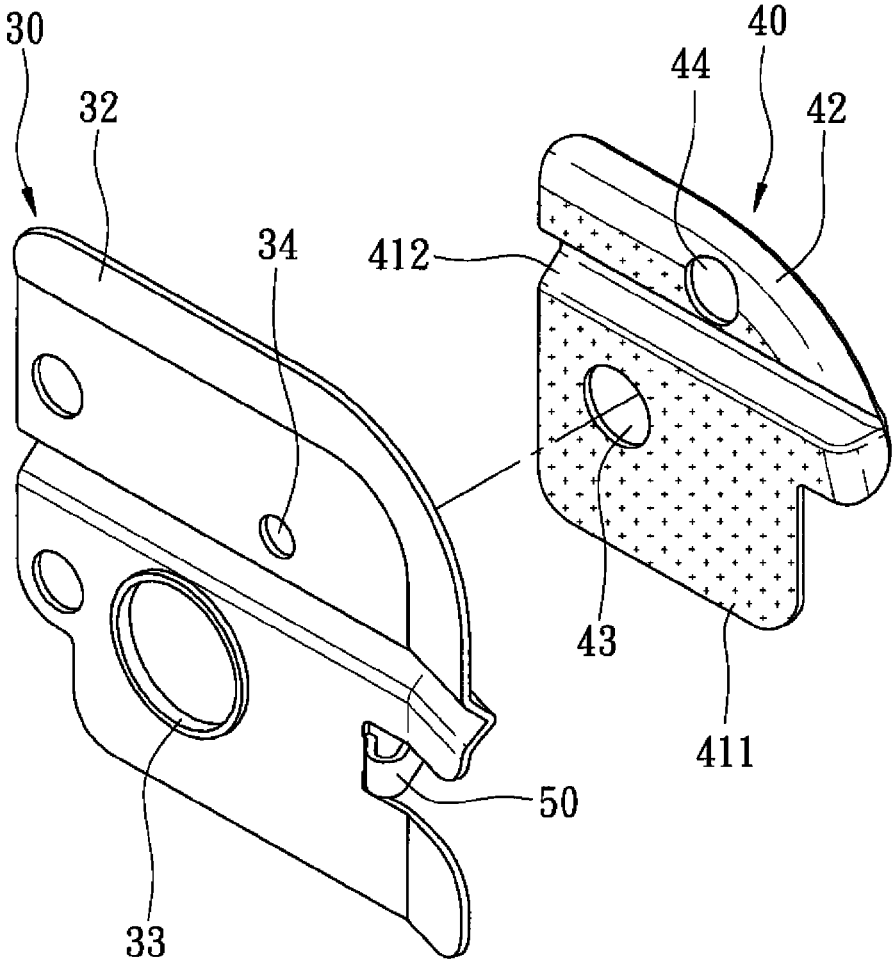
FIG. 6 is an exploded perspective view of first and second discs of the thread holding device.
Figure 7:
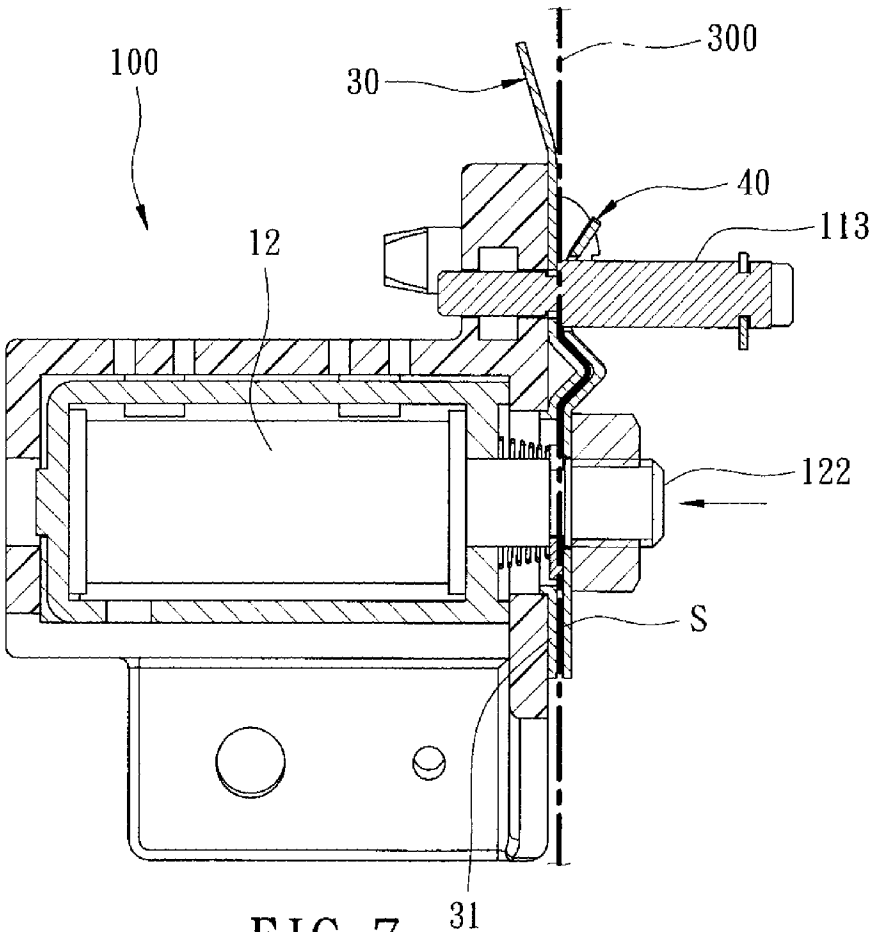
FIG. 7 is a sectional view similar to FIG. 4, showing the second disc in a holding position.

The second disc 40 is movable relative to the first disc 30 between holding and releasing positions, where the second disc 40 is closer to and remote from the first disc 40, respectively, and has a second holding surface 411 which confronts and cooperates with the first holding surface 311 to define a thread holding clearance (S) so as to permit passage of the needle thread 300 therethrough. Thus, in the releasing position, as shown in FIGS. 1 and 4, the needle thread 300 is permitted to continue on running from the lever threading portion 241 to the needle-bar thread guide 260. In the holding position, as shown in FIGS. 1 and 7, the needle thread 300 is arrested from moving along the threading path. The second disc 40 has a mating groove region 412 which is disposed on the second holding surface 411 and which extends transversely relative to the threading path so as to mate with the rib region 312 to concentrate a clamping force when the second disc 40 is displaced to the holding position. The second disc 40 further has a plunger hole 43 and a shaft hole 44 aligned axially and respectively with the plunger hole 33 and the shaft hole 34. In this embodiment, as shown in FIG. 6, the second holding surface 411 is roughened so as to increase the friction with the needle thread 300. Moreover, the fencing portion 50 can guard the passage of the needle thread 300 through the thread holding clearance (S).

In this embodiment, the thread holding clearance (S) has an upper region (S1) which is defined by upper portions 32, 42 of the first and second discs 30, 40 and which is configured to be divergent upwardly so as to facilitate entry of the needle thread 300 into the thread holding clearance (S).

The electromechanical unit 10 includes a housing 11 and an electromagnetic solenoid unit 12 mounted in the housing 11. The housing 11 is secured to the thread guide frame 250 and defines an accommodation chamber 111 which extends axially to terminate at an end wall 112 that is attached to the first disc 30 and that has a plunger hole 115 in spatial communication with the accommodation chamber 111. The plunger hole 115 is aligned with the plunger holes 33, 43 in the first and second discs 30, 40. The electromagnetic solenoid unit 12 includes a plunger 122 having a plunger end 125 which extends through the plunger holes 115, 33, 43. A washer 123 is sleeved on the plunger end 125, and a screw nut 124 is threadedly engaged with the plunger end 125 so as to tighten the second disc 40 between the washer 123 and the screw nut 124. Thus, the plunger end 125 is movable axially toward the plunger hole 115 to displace the second disc 40 to the holding position. The electromagnetic solenoid unit 12 further includes a solenoid member 121 activated to move the plunger 122 and thrust the second disc 40 toward the holding position.

The biasing member 60 is in the form of a coil spring 60 which is sleeved on the plunger 122 and which abuts against the solenoid member 121 and the washer 123 so as to bias the second disc 40 away from the solenoid member 121 toward the releasing position.

Further, a movement guiding shaft 113 is disposed to extend axially from the end wall 112 and is parallel to the plunger 122 so as to extend through the shaft holes 34, 44 of the first and second discs 30, 40 to guide the axial movement of the second disc 40. A stop ring 114 is disposed on the movement guiding shaft 113 for limit the axial movement of the second disc 40.

According to this embodiment, when the cutting operation of the needle thread 300 is performed, the needle thread 300 can be clamped with the clamping force in the thread holding clearance (S) which is disposed between the lever threading portion 241 and the needle-bar thread guide. Hence, the needle thread 300 extending between the thread holding clearance (S) and the needle 270 stands still to prevent the needle thread 300 from being pulled out of an eye of the needle 270. Thus, a required amount of the needle thread remaining, such as that having 5-10 cm in length, on the needle 270 can be secured even when the thread take-up lever 240 is moved up to its top dead center. Moreover, the configuration of the upper region (S1) defined by upper portions 32, 42 of the first and second discs 30, 40 is divergent upwardly so as to facilitate manual introduction of the needle thread 300 into the thread holding clearance (S). Furthermore, by virtue of the rib and mating groove regions 312, 412 and the roughened second holding surface 411, the needle thread 300 can be clamped firmly with the clamping force and the friction in the thread holding clearance (S).

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A sewing machine comprising:

a sewing head;

a needle bar mounted on said sewing head to be reciprocally movable upward and downward, and having a needle-bar thread guide through which a needle thread is passed;

a thread take-up lever mounted on said sewing head and upwardly of said needle bar to be swung upward and downward in synchronization with said needle bar, and having a lever threading portion through which the needle thread is passed and which is disposed upstream of said needle-bar thread guide in terms of a threading path of the needle thread;

a thread guide frame mounted on said sewing head and between said needle bar and said thread take-up lever; and a thread holding device including:

a first disc fixed to said thread guide frame, and having a first holding surface which faces the threading path and upstream of said needle-bar thread guide, a second disc movable relative to said first disc between holding and releasing positions, where said second disc is closer to and remote from said first disc, respectively, and having a second holding surface which confronts and cooperates with said first holding surface to define a thread holding clearance so as to permit passage of the needle thread therethrough such that, in the releasing position, the needle thread is permitted to continue on running from said lever threading portion to said needle-bar thread guide, and such that, in the holding position, the needle thread is arrested from moving along the threading path, an electromechanical unit disposed to be actuated to thrust said second disc to the holding position, and a biasing member disposed to bias said second disc toward the releasing position.

2. The sewing machine as claimed in claim 1, wherein said first disc has a fencing portion extending from said first holding surface toward said second holding surface and disposed at the threading path so as to guard the passage of the needle thread through said thread holding clearance.

3. The sewing machine as claimed in claim 1, wherein said thread holding clearance has an upper region which is configured to be divergent upwardly so as to facilitate entry of the needle thread into said thread holding clearance.

4. The sewing machine as claimed in claim 1, wherein said first and second discs respectively have rib and mating groove regions which are disposed respectively on said first and second holding surfaces, and which extend transversely relative to the threading path so as to concentrate a clamping force when said second disc is displaced to the holding position.

5. The sewing machine as claimed in claim 1, wherein said second holding surface is roughened so as to increase friction with the needle thread.

6. The sewing machine as claimed in claim 1, wherein said electromechanical unit includes a housing secured to said thread guide frame and defining an accommodation chamber which extends axially to terminate at an end wall that is attached to said first disc and that has a plunger hole in spatial communication with said accommodation chamber, a plunger disposed in said housing and having a plunger end which extends through said plunger hole and which is engaged with said second disc, said plunger end being movable axially toward said plunger hole to displace said second disc to the holding position, and a solenoid member disposed in said accommodation chamber and activated to move said plunger toward the holding position.

7. The sewing machine as claimed in claim 6, wherein said electromechanical unit includes a washer sleeved on said plunger, and a screw nut threadedly engaged with said plunger end to tighten said second disc between said washer and said screw nut, said biasing member being a coil spring which is sleeved on said plunger and which abuts against said solenoid member and said washer so as to bias said second disc away from said solenoid member toward the releasing position.

8. The sewing machine as claimed in claim 6, further comprising a movement guiding shaft which extends axially from said end wall and which is parallel to said plunger, said second disc having a shaft hole configured to permit extension of said movement guiding shaft to guide said second disc to move therealong.

* * * * *